US008807143B2

(12) United States Patent
Fiebelkorn

(10) Patent No.: US 8,807,143 B2
(45) Date of Patent: Aug. 19, 2014

(54) SMOKING ARTICLE FILTER

(75) Inventor: Richard Fiebelkorn, London (GB)

(73) Assignee: British American Tobacco (Investments) Limited, London (GB)

( * ) Notice: Subject to any disclaimer, the term of this patent is extended or adjusted under 35 U.S.C. 154(b) by 571 days.

(21) Appl. No.: 13/132,284

(22) PCT Filed: Nov. 20, 2009

(86) PCT No.: PCT/EP2009/065529

§ 371 (c)(1), (2), (4) Date: Nov. 9, 2011

(87) PCT Pub. No.: WO2010/063591

PCT Pub. Date: Jun. 10, 2010

(65) Prior Publication Data

US 2012/0060855 A1 Mar. 15, 2012

(30) Foreign Application Priority Data

Dec. 1, 2008 (GB) ..... 0821803.4

(51) Int. Cl.
*A24D 3/04* (2006.01)

(52) U.S. Cl.
USPC ..... 131/336

(58) Field of Classification Search
None
See application file for complete search history.

(56) References Cited

U.S. PATENT DOCUMENTS

| | | | | |
|---|---|---|---|---|
| 4,256,122 | A * | 3/1981 | Johnson | 131/336 |
| 4,498,487 | A * | 2/1985 | Frattolillo | 131/336 |
| 4,582,071 | A | 4/1986 | Westcott et al. | |
| 4,631,045 | A | 12/1986 | Frattolillo | |
| 4,718,436 | A | 1/1988 | Luke | |
| 6,854,469 | B1 * | 2/2005 | Hancock et al. | 131/60 |

FOREIGN PATENT DOCUMENTS

| | | | |
|---|---|---|---|
| DE | 2943561 | A1 | 3/1981 |
| DE | 3126918 | A1 | 1/1983 |
| EP | 0059040 | A1 | 9/1982 |
| EP | 0083197 | A1 | 7/1983 |
| EP | 0101173 | A1 | 2/1984 |
| EP | 1688052 | A1 | 8/2006 |
| EP | 1797780 | A1 | 6/2007 |
| FR | 2414884 | A1 | 8/1979 |
| GB | 864247 | A | 3/1961 |
| GB | 2089641 | A | 6/1982 |
| GB | 2090117 | A | 7/1982 |
| GB | 2135166 | A | 8/1984 |

(Continued)

OTHER PUBLICATIONS

International Search Report and Written Opinion corresponding to PCT/EP2009/065529 mailed Mar. 9, 2010.

(Continued)

*Primary Examiner* — Michael J Felton
(74) *Attorney, Agent, or Firm* — NW Poulsen

(57) ABSTRACT

A filter for a smoking article comprises elongate body 4 of filter material 7 for filtering smoke, an inner wrapper comprising first and second regions 9, 10 of non-porous material around and spaced apart along the length the filter material 7 to define a gap 11 that acts as a ventilation zone, and an outer wrapper 13 of porous material overlying the inner wrapper such as to allow ventilation air to be drawn through the ventilation zone and pass into the filter material (a) through the porous third wrapper and (b) longitudinally between inner wrapper and the outer wrapper.

26 Claims, 6 Drawing Sheets

(56) References Cited

FOREIGN PATENT DOCUMENTS

Figure 1:
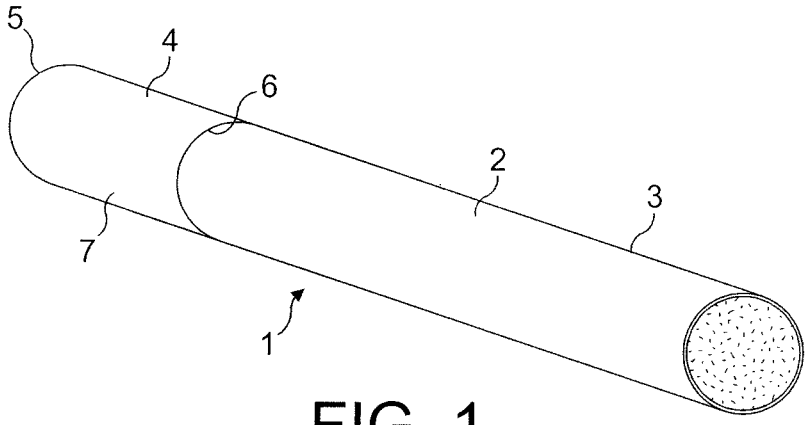

| | | | |
|---|---|---|---|
| JP | 57-132873 | A | 8/1982 |
| JP | 2004-248570 | A | 9/2004 |
| WO | 2007125426 | A2 | 11/2007 |
| WO | WO2009019154 | A1 | 2/2009 |

OTHER PUBLICATIONS

International Preliminary Report on Patentability, issued Jun. 7, 2011, for International Patent Application No. PCT/EP2009/065529, filed Nov. 20, 2009.

* cited by examiner

SMOKING ARTICLE FILTER

CLAIM FOR PRIORITY

This application is a National Stage Entry entitled to and hereby claims priority under 35 U.S.C. §§365 and 371 to corresponding PCT Application No. PCT/EP2009/065529, filed Nov. 20, 2009, which in turn claims priority to British Application Serial No. GB 0821803.4, filed Dec. 1, 2008. The entire contents of the aforementioned applications are herein expressly incorporated by reference.

FIELD OF THE INVENTION

This invention relates to a filter for use with a smoking article such as a cigarette.

BACKGROUND OF THE INVENTION

Hitherto, it has been proposed to provide a filter for a smoking article such as a cigarette, from a cellulose acetate tow wrapped in a plug wrap and attached to a rod of smoking material such as tobacco, by means of tipping paper which overlaps both the filter and the end of the rod. Smoke is drawn from the tobacco rod end of the filter to its mouth end when a smoker inhales smoke from the cigarette. It has been proposed to dilute the smoke inhaled by the smoker, by forming ventilation holes in the filter to allow outside air to pass laterally into the filter material and dilute the flow of smoke to the user. However, a problem with such an arrangement is that the user may place their fingers over the ventilation holes and reduce the flow of ventilation air. Several proposals have been made to overcome this difficulty. For example, U.S. Pat. No. 4,718,436 discloses a tipping paper arrangement in which lateral ventilation channels are formed.

The present invention provides an improved way of admitting ventilation and air into the filter which is less complex to construct and can readily be accommodated within the smoking article manufacturing process.

SUMMARY OF THE INVENTION

According to the invention there is provided a filter for a smoking article, comprising an elongate body of filter material, an inner wrapper comprising first and second regions of non-porous material around and spaced apart along the length the filter material to define a gap that acts as a ventilation zone, and an outer wrapper overlying the inner wrapper and configured to allow ventilation air to be drawn through the ventilation zone and pass into the filter material through the outer wrapper and longitudinally between inner wrapper and the outer wrapper.

At least one the first and second regions of the inner wrapper may comprise a portion of non porous tipping paper and conveniently both the first and second regions of the inner wrapper comprise first and second portions of non porous tipping paper.

At least one of the first and second regions of the inner wrapper can comprise a non porous coating around the filter such as glue that attaches the outer wrapping to the inner wrapping.

A spacer member such as a corrugated sheet may be provided between the inner and outer wrappers to facilitate the passage of ventilation air longitudinally between them.

The first region of inner wrapper may be more adjacent to the mouth end than the second region, and the outer wrapper can be attached to the first region of the inner wrapper such that ventilation air cannot substantially be drawn into the ventilation zone between the outer wrapper and the first region of the inner wrapper.

The outer wrapper may comprise naturally porous tipping paper and ventilation holes may be formed in the outer wrapper and/or in the body of filter material in the ventilation zone.

A rod of smokeable material can attach to the filter for example by means of the inner wrapper, and the outer wrapper may extend beyond the inner wrapper on the rod.

The invention also includes a method of manufacturing a smoking article comprising: wrapping an elongate body of filter material with an inner wrapper comprising first and second regions of non-porous material spaced apart along the length the filter material to define a gap to act as a ventilation zone, wrapping the filter material with an outer wrapper overlying the inner wrapper, and coupling the outer wrapper to the inner wrapper such as to allow ventilation air to be drawn through the ventilation zone and pass into the filter material through the outer wrapper and longitudinally between inner wrapper and the outer wrapper.

BRIEF DESCRIPTION OF DRAWING FIGURES

Figure 2:
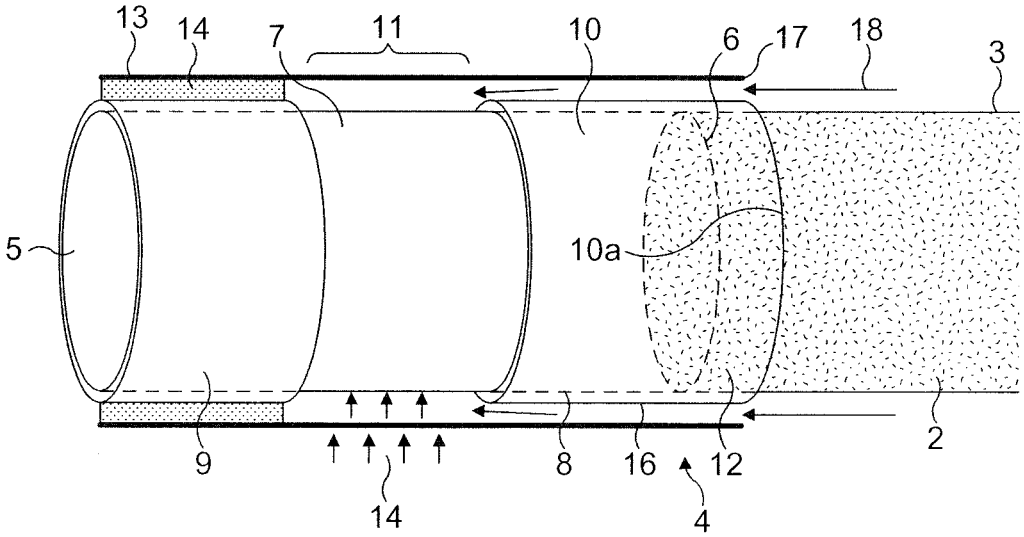
Figure 3:
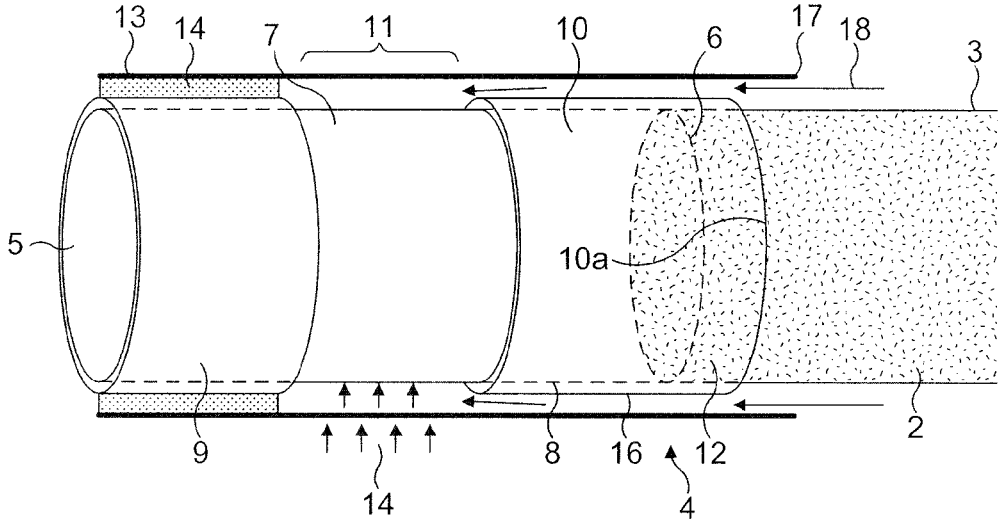
Figure 4:
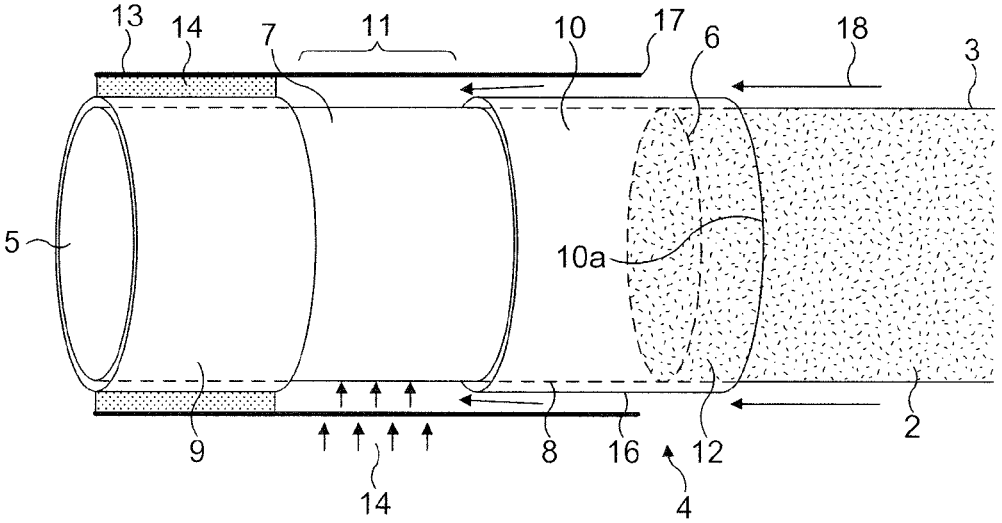
Figure 5:
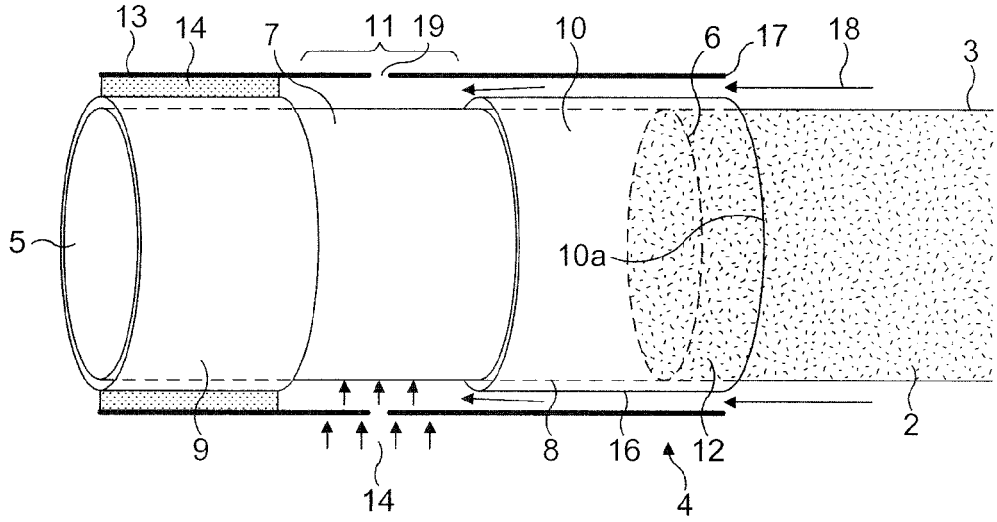
Figure 6:
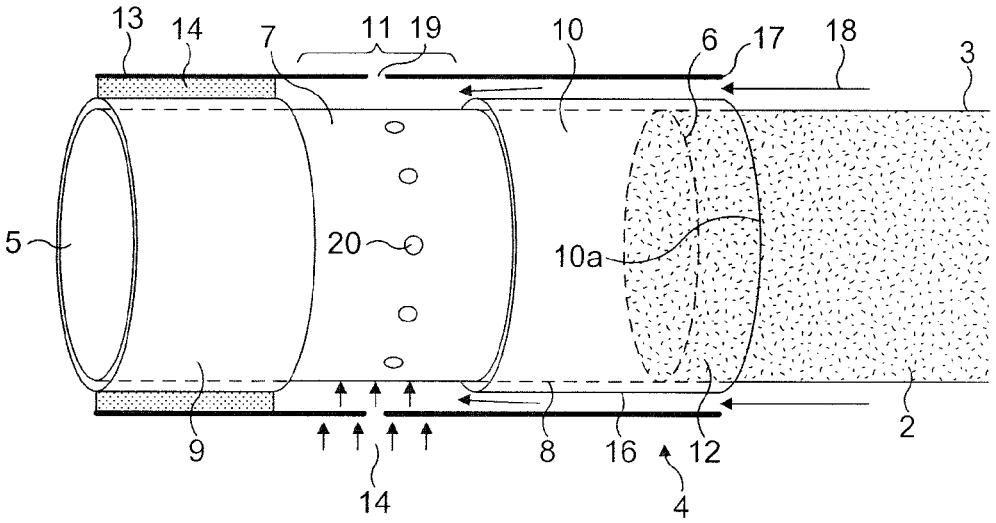
Figure 7:
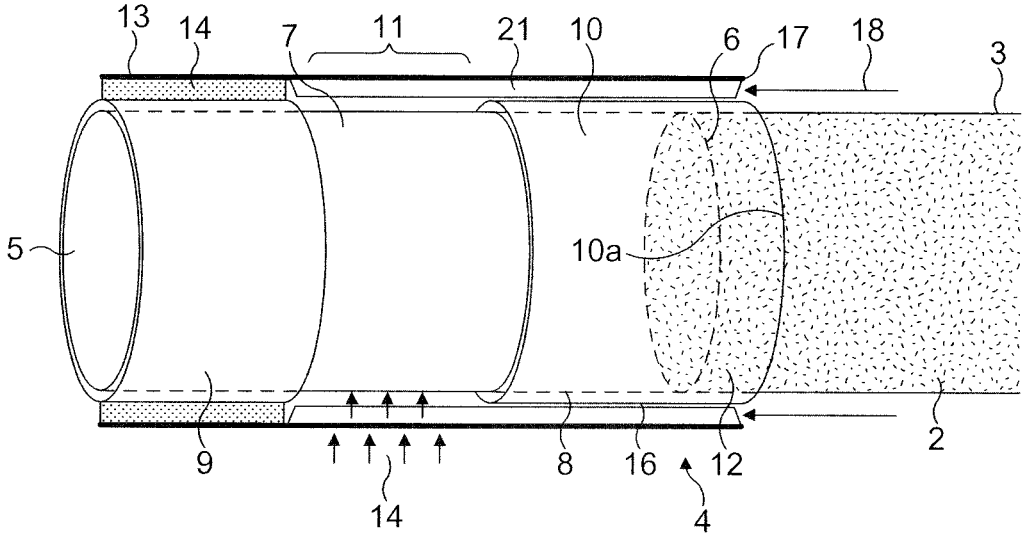
Figure 8:
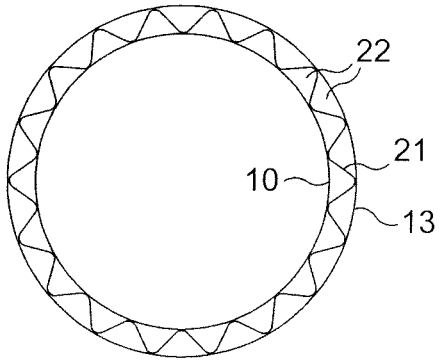
Figure 9:
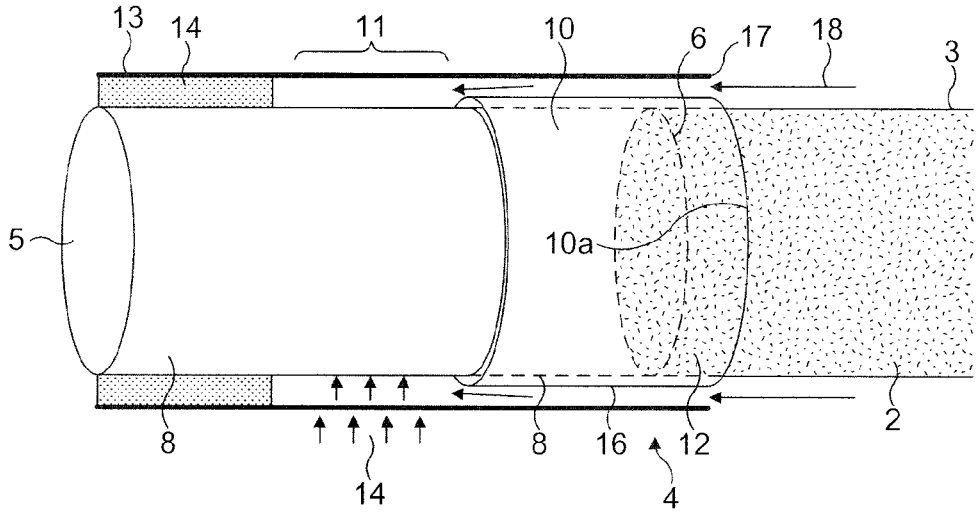

In order that the invention may be more fully understood the embodiment thereof will now be described by way of example with reference to the accompanying drawings in which:

FIG. 1 is a schematic illustration of a filter cigarette,

FIG. 2 illustrates the interior structure of the filter of FIG. 1 in more detail, FIG. 3 illustrates an alternative configuration for the filter of FIG. 2, in which the outer wrapper is longer than the inner wrapper, FIG. 4 illustrates another alternative, in which the outer wrapper has a shorter length than the inner wrapper, FIG. 5 illustrates the filter configuration with ventilation holes added in the outer wrapper, FIG. 6 corresponds to FIG. 5, with ventilation holes additionally provided in the filter body, FIG. 7 illustrates an alternative configuration with a circumferential corrugated spacer member between the inner and outer wrappers, FIG. 8 is an end view of the filter illustrated in FIG. 7, FIG. 9 illustrates a further filter configuration in which one of the non porous portions of tipping paper forming the inner wrapper is replaced by a coating of glue, and FIGS. 10A-10G illustrate steps in the manufacture of a cigarette incorporating a filter as illustrated in any of the preceding Figures.

DETAILED DESCRIPTION

Referring to FIG. 1 a smoking article in the form of a cigarette 1 comprises a tobacco rod 2 in a paper wrap 3 attached to a filter 4. The filter 4 has a mouth end 5 and a tobacco rod end 6. The filter 4 may comprise a generally cylindrical body of filter material 7 in a plug wrap typically made of paper (not shown in FIG. 1). In use, a smoker draws on the mouth end 5 so that the smoke is drawn from the burning tobacco rod into the tobacco rod end 6 of the filter, so as to be filtered on its passage to the mouth end 5.

The structure of the filter 4 is illustrated in more detail in FIG. 2. The body 7 of filter material may typically comprise a cellulose acetate tow contained within plug wrap 8, in an elongate, generally cylindrical configuration. Filter bodies for cigarettes are well known per se and may contain additional materials to assist filtering, for example activated carbon and the like and may also include flavourants, for example menthol.

The filter body 7 and plug wrap 8 are wrapped with an inner wrapper that comprises first and second regions 9, 10 of non-porous material which may comprise tipping paper portions that are wrapped around and spaced apart along the length of the body of the filter material 7 to define a gap 11 that acts as a ventilation zone to admit air into the filter material 7 in order to dilute the smoke inhaled by the smoker though the mouth end 5. The second portion 10 of the non-porous tipping paper overlaps in region 12 the end of the tobacco rod 2 that abuts the filter body 7. Both of the inner wrapper portions 9, 10 are glued in place and so the portion 10 retains the filter 4 on the tobacco rod 2.

A porous outer wrapper 13 conveniently formed of naturally porous tipping paper is wrapped around the inner wrapper 9, 10 and glued in an area 14 illustrated in hatched outline.

Ventilation air can enter the ventilation zone 11 when a smoker draws on the mouth end 5 of the cigarette along two paths. Firstly, the ventilation air can pass through the porous outer wrapper 13 in the direction of arrows 14 so as to enter the ventilation zone 11. Secondly, ventilation air can be drawn in the direction of arrow 16 though the space between the outer wrapper 13 and the inner wrapper portion 10, it being understood that the outer wrapper 13 is not glued to the inner wrapper portion 10 so that air can be admitted though the circumferential opening between inner wrapping portion 10 and end 17 of the outer wrapper 13 in the direction of arrow 18. This arrangement has the advantage that if the user holds the filter between their fingers, although the action will tend to close the passageway that extends in the direction of arrow 16 between the inner and outer wrappers 10, the closure will only occur in typically two radial portions where the fingers of the user grip the filter, thereby leaving the remainder of the circumferential passageway open for use. Similarly, although the users fingers may obturate the passage of air in the direction of arrow 15 in regions where zone 11 is gripped, only a portion of the total surface area that can admit ventilation air through the outer wrapper 13 is blocked, leaving the major part free to admit air in response to the user drawing smoke through the filter. Thus, the filter arrangement provides a highly reliable configuration for admitting ventilation air into the filter to dilute smoke drawn by the user.

FIG. 3 illustrates a modification of the configuration shown in FIG. 2, in which edge 17 of the outer wrapper extends longitudinally over the tobacco rod, beyond the corresponding edge 10*a* of the second, inner wrapper portion 10. In an alternative configuration shown in FIG. 4, the end 17 of the outer wrapper 13 stops short of the join between the filter body 7 and the tobacco rod 2.

FIG. 5 illustrates a further modification in which ventilation holds 19 are formed in the outer wrapper 13 in the region of the ventilation zone 11. Additionally, as shown in FIG. 6, ventilation holes 20 may be formed in the body 7 of the filter material itself. The ventilation holes 19, 20 may be formed by laser perforation in a manner known per se.

As illustrated in FIGS. 7 and 8, a spacer member 21 in the form of a corrugated paper structure, may be included between the outer wrapper 13 and the inner wrapper in the region of ventilation zone 11 and the second portion 10 of the inner wrapper. As shown in FIG. 8, the corrugated member 21 acts as a spacer and provides channels 22 extending longitudinally of the cigarette to facilitate the passage of ventilation air between the inner and outer wrappers 10, 13 in the direction of arrow 18.

In a further embodiment illustrated in FIG. 9, the first paper wrapper portion 9 of the inner wrapper portion is replaced by a non-porous layer of glue that attaches the outer wrapper 13 directly to the plug wrap in region 23 adjacent the mouth end. The glue provides a non porous coating between the mouth end 5 of the filter and the ventilation zone 11 and thus acts as the first region 9 of the inner wrapper.

A process for manufacturing cigarettes incorporating the filters according to the invention is illustrated schematically in FIG. 10. Referring to FIG. 10A, a rod of filter material 4 wrapped with plugwrap (not shown) of a length suitable for two cigarettes, is brought into alignment with tobacco rods 2, 2' in order to manufacture two cigarettes end-to-end.

Figure 10A:
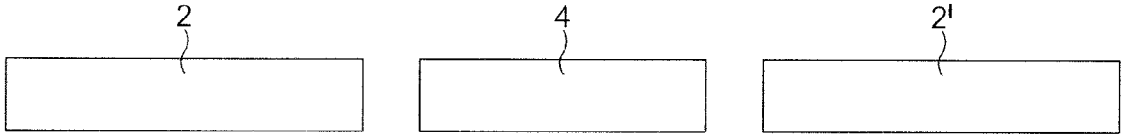
Figure 10B:
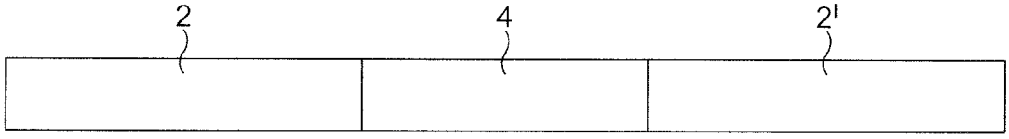
Figure 10C:
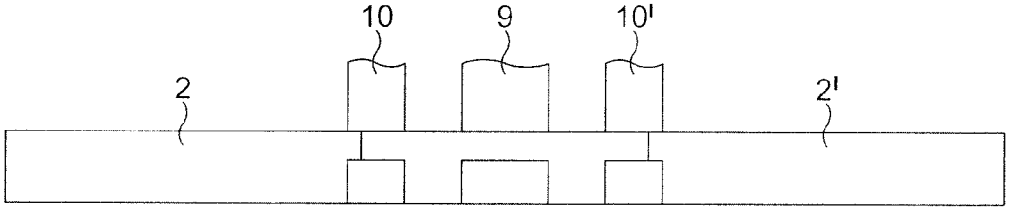

The tobacco rods 2, 2' and the filter material 4 are brought into an abutting relationship as shown in FIG. 10B and then as shown in FIG. 10C are wrapped with inner wrappers 9, 10 & 10' that are glued around the middle of the filter material 4 and the butt joints between the filter material 4 and the tobacco rods, 2, 2' respectively. The inner wrapper 9 is twice the width of the wrappers 10, 10'.

Figure 10D:
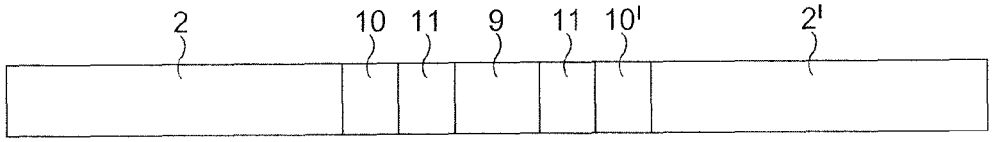
Figure 10E:
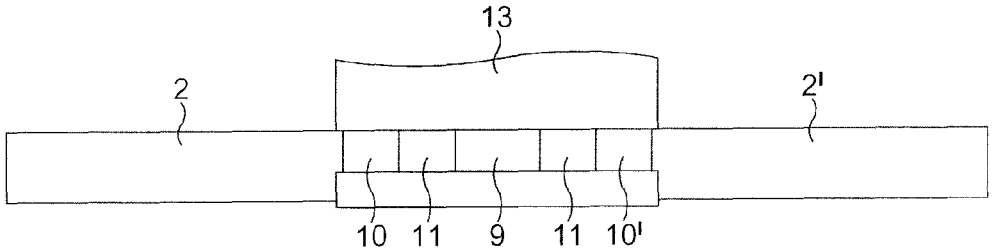
Figure 10F:
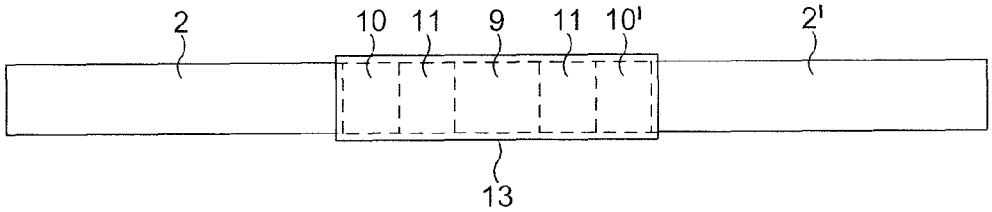
Figure 10G:
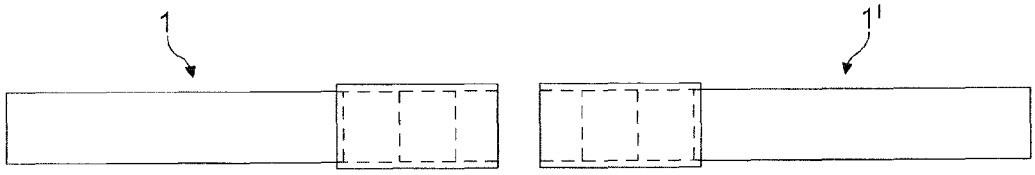

The inner wrappers 9 and 10, 10' are spaced apart by regions 11, 11' which forms ventilation zones. The resulting configuration is shown in FIG. 10D Referring to FIG. 10E, the body 4 filter material is then wrapped with outer wrapper 13, of naturally porous tipping paper. The tipping paper 13 is glued only to the inner wrapper 9 and not to the inner wrappers 10, 10' or the ventilation zones 11, 11'. To this end, the wrapper 9 may be pre-coated with a glue to assist in the process. The resulting configuration is illustrated in FIG. 10F and comprises two cigarettes each with a filter as previously described, configured end-o-end. The two cigarettes are then separated in a cutting step as illustrated in FIG. 10G so as to form cigarettes 1, 1'

Many modifications to the described manufacturing process will be evident those skilled in the art, and for example, the width of the outer wrapper 13 may be modified to achieve any of the configurations illustrated in FIG. 2, 3 or 4 and furthermore, ventilation holes, 19, 20 may be produced by an on-machine laser technique in the manner known per se.

Also, although the filter has been described as comprising a single body of filter material, it may be a multi-section filter, with each section having respective, different filtering characteristics.

Whilst the invention has been described by way of example with reference to a filter for a cigarette, it can be used for other smoking articles and as used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products.

The invention claimed is:

1. A filter for a smoking article, comprising:

an elongate body of filter material;

an inner wrapper comprising first and second regions of non-porous material around and spaced apart along the length of the filter material to define a gap that acts as a ventilation zone; and an outer wrapper overlying the inner wrapper that allows ventilation air to be drawn through the ventilation zone and pass into the filter material through the outer wrapper and longitudinally between the inner wrapper and the outer wrapper.

2. The filter according to claim 1 wherein at least one of the first and second regions of the inner wrapper comprises a portion of non-porous tipping paper.

3. The filter according to claim 2 wherein the first and second regions of the inner wrapper comprise first and second portions of non-porous tipping paper.

4. The filter according to claim 1 wherein at least one of the first and second regions of the inner wrapper comprises a non-porous coating.

5. The filter according to claim 4 wherein the non-porous coating comprises glue that attaches the outer wrapping to the inner wrapping.

6. The filter according to claim 1, further comprising a spacer member between the inner wrapper and outer wrapper to facilitate passage of the ventilation air longitudinally between the inner wrapper and the outer wrapper.

7. The filter according to claim 6 wherein the spacer member comprises a corrugated circumferential member between the inner wrapper and outer wrapper that defines longitudinal air flow channels.

8. The filter according to claim 1 having a mouth end and a tobacco end, wherein the first region of inner wrapper is more adjacent to the mouth end than the second region which is more adjacent to the tobacco end, and the outer wrapper is attached to the first region of the inner wrapper such that ventilation air cannot substantially be drawn into the ventilation zone between the outer wrapper and the first region of the inner wrapper.

9. The filter according to claim 1 wherein the outer wrapper comprises porous sheet material.

10. The filter according to claim 1 wherein the outer wrapper comprises naturally porous tipping paper.

11. The filter according to claim 1 further comprising ventilation holes formed in at least one of the outer wrapper and the body of filter material in the ventilation zone.

12. The filter according to claim 1 wherein the body of filter material comprises a plurality of filter sections with different filtering characteristics.

13. The smoking article according to claim 1 further comprising a rod of smokeable material attached to the filter.

14. The smoking article according to claim 13 wherein the inner wrapper attaches the rod of smokable material to the filter.

15. The smoking article according to claim 13 wherein the outer wrapper extends beyond the inner wrapper on the rod of smokable material.

16. A method of manufacturing a smoking article comprising:

wrapping an elongate body of filter material with an inner wrapper comprising first and second regions of non-porous material spaced apart along the length of the filter material to define as gap to act as a ventilation zone;

wrapping the filter material with an outer wrapper overlying the inner wrapper; and coupling the outer wrapper to the inner wrapper to allow ventilation air to be drawn through the ventilation zone and pass into the filter material through the outer wrapper and longitudinally between the inner wrapper and the outer wrapper.

17. The method according to claim 16 further comprising applying a portion of non-porous tipping paper to form at least one of the first and second regions of the inner wrapper.

18. The method according to claim 16 further comprising non-porous coating to provide at least one of the first and second regions of the inner wrapper.

19. The method according to claim 16 further comprising applying a glue as a non-porous coating, that attaches the outer wrapping to the inner wrapping.

20. The method according to claim 16 further comprising providing a spacer member between the inner wrapper and the outer wrapper to facilitate passage of ventilation air longitudinally between the inner wrapper and the outer wrapper.

21. The method according to claim 16 further comprising applying a porous tipping paper to provide the outer wrapper.

22. The method according to claim 16 further comprising forming ventilation holes in at least one of the outer wrapper and the body of filter material in the ventilation zone.

23. The method according to claim 16 further comprising attaching a rod of smokeable material to the filter material.

24. The method according to claim 23 wherein the rod of smokeable material is attached to the filter material by the inner wrapper.

25. The method according to claim 23 wherein the outer wrapper is applied so that it extends beyond the inner wrapper on the rod of smokable material.

26. A filter for a smoking article, comprising:

an elongate body of filter material and a porous plug wrap covering the lateral surface of the elongate body of filter material;

an inner wrapper comprising first and second regions of non-porous material around and spaced apart along the length the filter material to define a ventilation zone gap, wherein the first region of the inner wrapper is disposed at a mouth end of the elongate body of filter material and the second region of the inner wrapper is disposed at a tobacco end of the elongate body of filter material; and an outer wrapper overlying the inner wrapper, wherein the outer wrapper is glued to the first region of the inner wrapper forming a circumferential opening between the second region of the inner wrapper and the outer wrapper, and wherein the outer wrapper is configured to allow ventilation air to be drawn through the ventilation zone and pass into the filter material through the outer wrapper and longitudinally between the inner wrapper and the outer wrapper through the circumferential opening.

* * * * *